United States Patent [19]

Newton

[11] Patent Number: 4,905,620

[45] Date of Patent: Mar. 6, 1990

[54] WATERTIGHT MAST FOR SAILING VESSEL

[75] Inventor: John R. Newton, Beaumont, Tex.

[73] Assignee: CKY, Inc., Port Arthur, Tex.

[21] Appl. No.: 103,167

[22] Filed: Sep. 30, 1987

[51] Int. Cl.[4] ..... B63B 15/00

[52] U.S. Cl. ..... 114/39.1; 114/90

[58] Field of Search ..... 114/89, 90, 39.1, 93, 114/123, 39.2, 121

[56] References Cited

U.S. PATENT DOCUMENTS

| | | | |
|---|---|---|---|
| 377,490 | 2/1888 | Mansfield | 114/90 |
| 3,585,952 | 6/1971 | Head . | |
| 3,889,045 | 6/1975 | Logsdon | 114/90 |
| 4,326,478 | 4/1982 | Holmes | 114/90 |

FOREIGN PATENT DOCUMENTS

| | | | |
|---|---|---|---|
| 2833180 | 2/1980 | Fed. Rep. of Germany . | |
| 3402-503 | 8/1985 | Fed. Rep. of Germany . | |
| 3431151 | 3/1986 | Fed. Rep. of Germany | 114/90 |
| FR-A- | | | |
| 2413255 | 7/1979 | France . | |
| 2447316 | 9/1980 | France . | |
| WO-A- | | | |
| 8202863 | 3/1982 | PCT Int'l Appl. . | |
| 1197926 | 12/1985 | U.S.S.R. | 114/90 |
| 1197927 | 12/1985 | U.S.S.R. | 114/90 |
| 2182289 | 5/1987 | United Kingdom | 114/90 |

OTHER PUBLICATIONS

Marchaj, C. A., "Stability and its Effects on Safety," Seaworthiness, The Forgotten Factor, Int. Marine Publishing Co., 1986, pp. 88–99.

Marchaj, C. A., "Dynamic Metacentric Stability," Seaworthiness, The Forgotten Factor, Int. Marine Publishing Co., 1986, pp. 204–213.

*Primary Examiner*—Sherman D. Basinger

*Assistant Examiner*—Stephen P. Avila

*Attorney, Agent, or Firm*—Arnold, White & Durkee

[57] ABSTRACT

A mast is provided which functions as both a mast and a righting lever which provides an immediate and powerful addition to the righting moment of a sailing vessel. The mast comprises a hollow longitudinal member adapted for carrying a sail. The longitudinal member contains one or more internal compartments which are sealed to prevent fluid communication to the interior of the mast.

1 Claim, 2 Drawing Sheets

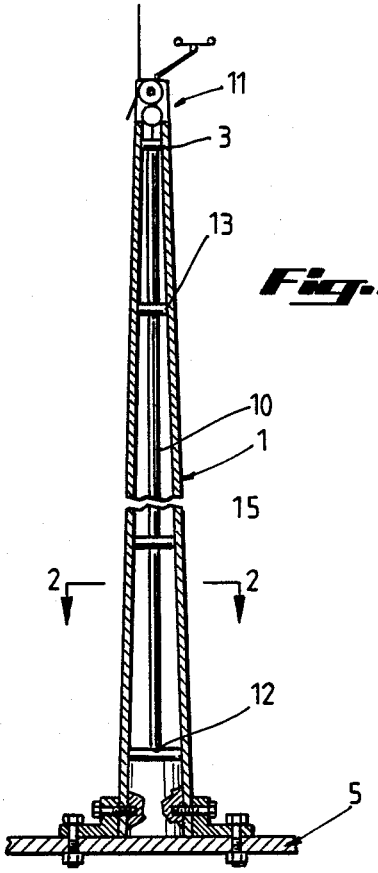
Fig.1
Fig.2
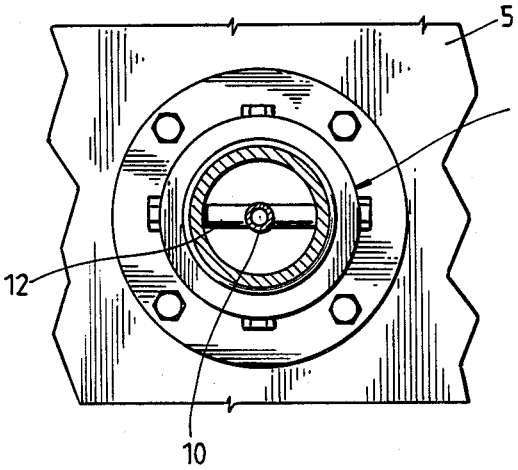
Fig.3
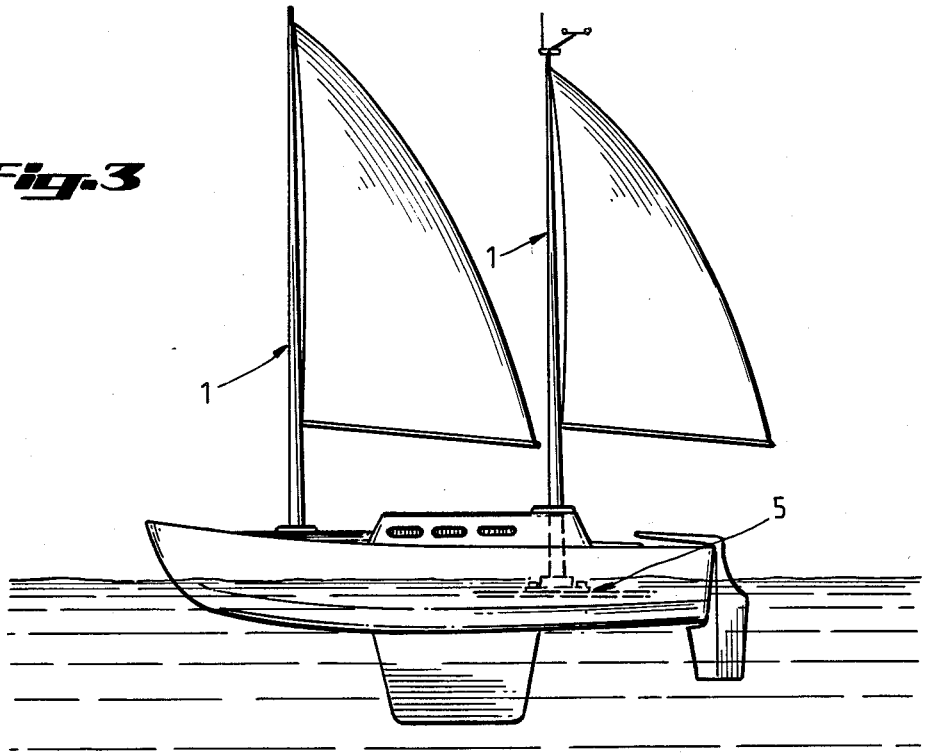

WATERTIGHT MAST FOR SAILING VESSEL

BACKGROUND OF THE INVENTION

The present invention relates to masts used for vessels, particularly sailing vessels.

Of the many motions experienced by sailing vessels, rolling is one of the most serious. What is desirable in a sailing vessel is transverse stability.

Stability can be measured by the metacentric height or righting lever. A hull in undisturbed water is essentially acted on by two resultant vertical forces. The buoyancy (displacement) factor is focused at one point called the center of buoyancy. The weight of the vessel acts at the center of gravity. When both forces act along the same vertical line, the hull is at equilibrium. When the hull is heeled to one side, the center of buoyancy moves away from the center of gravity, creating a righting moment or righting lever.

Most modern sailing vessels are designed for high initial stability. That is, during the early stages of a rolling motion, the righting moment for the hull increases rapidly causing the hull to return to equilibrium. Unfortunately, hulls designed for high initial stability during a roll, also have an increased danger zone of instability. For example, after the righting moment reaches a maximum value for a degree of heel for a particular hull, stability begins to decrease until the capsize threshold is reached. Once past this critical degree of heel, the hull will continue to roll until fully inverted. The hull generally becomes stable in the inverted position until the hull is rolled out to a point were positive stability is reached and the hull rights itself. This range of negative stability is extremely dangerous and results in the loss of life and the ultimate destruction of the vessel.

Heavier boats with a lower center of gravity aid in decreasing the range of negative stability. Still, the range of negative stability is not avoided. Moreover, the trend is towards lighter, faster boats. Unfortunately, this dramatically increases the negative stability zone.

Methods of dealing with negative stability problems include filling a mast with foam or adding buoyant sleeves around the mast. These methods are undesirable. First, any addition of weight to a mast must be compensated by increasing the ballast. For example, the addition of one pound to the top of a 44-foot mast could require an additional 44 pounds of ballast to compensate for the additional one pound to the mast. Further, additions to the outside of the mast are less efficient aerodynamically, and can only partially cover the mast in order to avoid interfering with the sails, halyards, etc. Moreover, the addition of foam alters the strength and bend characteristics of the mast. This can lead to, among other things, an increased likelihood of structural failure under certain conditions. Other methods have employed post capsize techniques, such as pumps to expel water from a hull and mast.

SUMMARY OF THE INVENTION

The present invention is an apparatus which functions as a mast and a righting lever without adding significant weight to the mast and without adding any external buoyancy devices. A vessel so equipped will right itself no matter what the position of the vessel, whether the sails are spread or not.

The present invention is a mast comprising a hollow longitudinal member adapted for carrying a sail. The longitudinal member provides walls for one or more internal compartments. Any open ends of the longitudinal member are sealed with, for example, a sealing member to prevent fluid communication with the internal compartment or compartments. The seal is completed, for example, by capping the ends of the hollow longitudinal member and sealing the capped end with a suitable waterproof sealant.

By sealing the mast to provide an internal compartment which is impervious to water, an immediate and powerful addition to the righting moment of the vessel is provided. The righting moment is so proportioned that it will assist the vessel in righting itself no matter how far rolled or pitched. Further, hull designs can be selected for high initial stability characteristics without regard for the negative righting effect.

DESCRIPTION OF THE DRAWINGS

FIG. 1 is a drawing of one embodiment of a mast constructed in accordance with the present invention.

FIG. 2 is a cross-section of the mast shown in FIG. 1.

FIG. 3 is an illustration of masts of the present invention as employed on a sailing vessel.

DETAILED DESCRIPTION AND PREFERRED EMBODIMENT

The present invention provides a mast which is capable of carrying sail sufficient to provide ample power for the vessel and which provides positive self-righting forces to the vessel.

Figure 4:
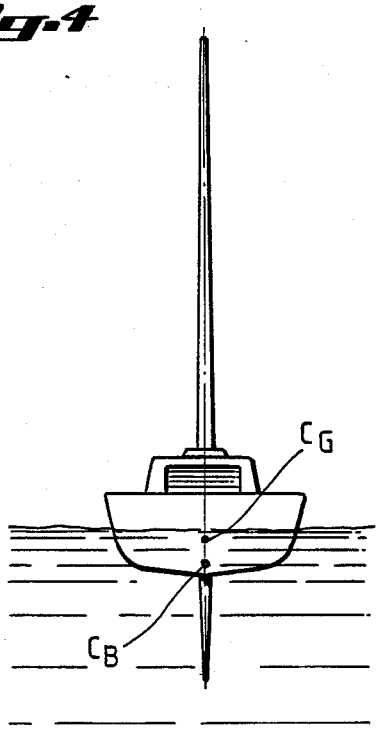
FIG. 4 is a diagram illustrating the relationship of the center of gravity and the center of buoyancy of a hull at equilibrium.
Figure 5:
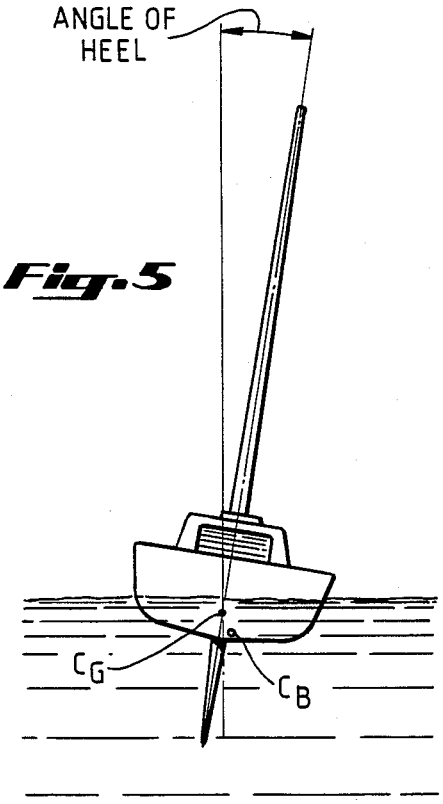
FIG. 5 is a diagram illustrating the relationship of the center of gravity and the center of buoyancy of the hull when heeled to one side.

All vessels are subject to the action of wind and waves. This causes the vessel to roll about its longitudinal axis and pitch about its lateral axis, or a combination of such actions. Referring to FIGS. 3–5, the modern, high-performance sailing vessel is designed such that its center of gravity and center of buoyancy are in vertical alignment when the hull is at equilibrium. The shape of the hull and the location of the ballast provides a center of buoyancy that will be displaced from the center of gravity when rolled or pitched. This displacement forms a couple that in its initial stages acts to return the vessel to a position of equilibrium.

Figure 6:
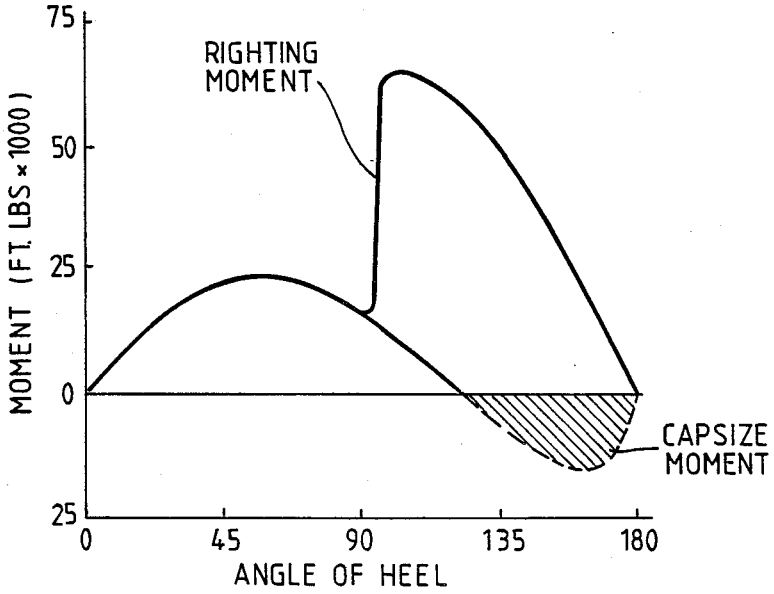
FIG. 6 is a graph illustrating the righting moment versus the angle of heel.

Referring to the graph of FIG. 6, when a modern sailing vessel is rolled or pitched beyond a 90-degree angle, the righting couple so rapidly decreases, it is extremely difficult for the vessel to right itself. When the angle of heel passes 100 degrees, the momentum of the rolling vessel carries it into the region of negative righting moment. Although the vessel can float in this position, it floats in an inverted position. Again referring to FIG. 6, when a sailing vessel employing the present invention is rolled to a 90-degree angle of heel, a powerful righting moment is provided by the mast. Consequently, sailing vessels so equipped do not possess a range of negative stability.

The mast of the present invention is a hollow longitudinal member which contains one of more internal compartments. That is, the mast is hollow and forms walls for one or more internal watertight compartments.

The mast can be constructed of any material that possesses sufficient strength to withstand the forces of a sail and to propel the vessel at its hull speed. In addition, the mast material must be impervious to water. Suitable materials include aluminum, carbon fiber or other resin bonded composite fibers.

The mast may be of any geometric shape that will assist in withstanding the bending, wracking and torsion forces imposed on it by the forces of the wind, sea, sail and motion of the vessel, or such combination of those forces as may be expected to be encountered.

The hollow longitudinal member forming the mast will typically have openings at the top and bottom. These openings can be sealed in any manner which will prevent fluid communication into the interior of the mast. For example, to complete the seal, the ends of the mast can be capped with a sealing member, then sealed. Of course, the seal must be watertight. The ends of the mast can be capped, for example, with an aluminum cap and then sealed with a suitable waterproof sealant. An especially good sealant material is 3M 5200 sealer (manufactured by 3M Co.). If desired, the top of the mast can be capped and sealed and the base of the mast set into the mast socket in the hull of the vessel and then sealed in the socket.

Once sealed, the internal compartment of the mast will generally extend the length of the mast itself. That is, the internal compartment is substantially coextensive with the longitudinal member forming the mast. However, if desired, in larger masts a series of watertight compartments can be incorporated into the mast by, for example, adding internal "walls" or internal sealing members which are substantially perpendicular to the walls formed by the longitudinal member. For example, material such as Airex® (manufactured by Airex AG, Switzerland) which is a semiflexible PVC foam, can be cut to conform to the circumferential shape of the mast and coated with an epoxy or other suitable resin. The sealing member can then be pulled up inside the mast with a leader to a desired point and the resin allowed to set. Once set, the internal sealing member can be sealed with a suitable sealant to prevent fluid communication between internal compartments.

FIGS. 1–2 illustrate one embodiment of the present invention. A mast 1 is attached to a hull member 5. The attachment can be by any suitable method for attaching a mast to a hull, such as by throughbolting the mast to a plate or glassing the mast to a structural portion of the vessel that is capable of withstanding the forces transmitted to it by the mast acting in its various capacities. As discussed above, sealing the lower portion of the mast attached to the hull member can be accomplished by applying a suitable waterproof sealant at the junction of the lower portion of the mast and the hull member.

An upper external seal 3 is applied at the opening at the top of the mast. As stated, this can be a cap such as an aluminum cap which is sealed with a waterproof sealant. A support member 11 can be placed above the seal and used for supporting sheaves and other mechanisms necessary to hoist and lower the sail, attach antennas, wind direction indicators, flag halyards, or any other device normally found fixed to sail boat masts.

If desired, lines, halyards, wires or other materials can be routed internally through the mast through an internal hollow longitudinal member such as a tube, or series of tubes. The internal member has openings at each end, and the member is sealed at its periphery at the points where it passes through the caps or sealing members of the mast or the mast itself so as to maintain the watertight integrity of the internal compartment or compartments. More specifically, the inner hollow longitudinal member has openings for communicating with the exterior of the mast. The exterior wall of the inner member and the inner wall of the exterior member thus define an annulus within the mast which is watertight when properly sealed.

As illustrated in FIG. 1, a vertical running tube 10, or series of tubes, if so desired, can be passed through seal 3 and sealed with a suitable waterproof sealant at the point where the tube or tubes pass through the seal in order to maintain the watertight integrity of the mast. Preferably, the seals should be capable of withstanding a waterhead of at least 100 psi. A horizontal running tube 12 can be installed in the lower portion of the mast and sealed to run lines, halyards, wire, to the exterior of the mast.

If desired, internal sealing members 13 and 15, for example, can be installed in the mast and sealed in place to provide a plurality of watertight compartments inside the mast. Any tubes running through the mast can also be sealed at the points where they pass through the internal sealing members with a suitable waterproof sealant.

The mast illustrated in FIGS. 1–2 is but one embodiment that can be practiced in accordance with this invention. Those skilled in the art will recognize other variations that can be employed in the practice of this invention. Those variations are within the spirit and scope of the present invention.

What is claimed is:

1. A mast for a sailing vessel, comprising:

(a) an outer hollow longitudinal member adapted for carrying a sail and imperious to water, said member possessing sufficient strength to withstand the forces of a sail and to propel a sailing vessel at its hull speed;

(b) one or more inner hollow longitudinal members impervious to water having means for communicating with the exterior of said mast;

(c) one or more annular internal compartments defined by the inner wall of said outer member and the outer wall of said inner member or members, said internal compartment or compartments being sealed to substantially inhibit fluid communication between said internal compartment or compartments and the exterior of said mast, said internal compartment or compartments being of sufficient capacity to impart a positive righting moment when said mast is in contact with the water.

* * * * *